US011629039B2

(12) United States Patent
Terrana et al.

(10) Patent No.: US 11,629,039 B2
(45) Date of Patent: Apr. 18, 2023

(54) FUNNEL

(71) Applicant: EMBEDDED STEPS LLC, Royal Oak, MI (US)

(72) Inventors: Edward Terrana, Royal Oak, MI (US); Sebastian Thomas Terrana, Mill Spring, NC (US)

(73) Assignee: EMBEDDED STEPS LLC, Royal Oak, MI (US)

( * ) Notice: Subject to any disclaimer, the term of this patent is extended or adjusted under 35 U.S.C. 154(b) by 0 days.

(21) Appl. No.: 17/197,224

(22) Filed: Mar. 10, 2021

(65) Prior Publication Data

US 2021/0284518 A1 Sep. 16, 2021

Related U.S. Application Data

(60) Provisional application No. 62/987,431, filed on Mar. 10, 2020.

(51) Int. Cl.
*B67C 11/00* (2006.01)
*B67C 11/02* (2006.01)

(52) U.S. Cl.
CPC ..... *B67C 11/00* (2013.01); *B67C 11/02* (2013.01)

(58) Field of Classification Search
CPC ..... B67C 11/00; B67C 11/02; B67C 11/04; B67C 11/06; B67C 2011/027; B67C 2011/022; B67C 2011/30; B67C 11/066; B67C 11/063; B67C 11/20; B67C 2011/40; B65B 39/00
USPC ..... 141/344, 340–343
See application file for complete search history.

(56) References Cited

U.S. PATENT DOCUMENTS 2,302,591 A * 11/1942 Ahern ..... A01M 1/2055 141/343
3,807,466 A * 4/1974 Minneman ..... B65B 39/00 86/20.12
3,927,703 A * 12/1975 Beaubien ..... B67C 11/02 141/333
3,986,538 A * 10/1976 Sather ..... B67C 11/02 141/332
4,022,257 A * 5/1977 O'Connell ..... F16N 31/002 210/474
4,130,147 A * 12/1978 Langlie ..... B67C 11/02 141/333
4,245,666 A * 1/1981 Norris ..... E04D 13/00 137/357
4,557,378 A * 12/1985 Klebold ..... B65D 25/44 141/337
4,559,984 A * 12/1985 Wycech ..... B67C 11/00 141/340
5,626,174 A * 5/1997 Schaffner ..... B67C 11/02 141/332
5,785,329 A * 7/1998 Stanley ..... B62B 3/104 141/88

(Continued)

*Primary Examiner* — Mary E McManmon
*Assistant Examiner* — Stephanie A Shrieves
(74) *Attorney, Agent, or Firm* — The Dobrusin Law Firm, P.C.; Daniela M. Thompson-Walters

(57) ABSTRACT

A funnel compatible with recreational vehicle fill ports. The funnel including: a) an input section having an inlet portion which is tapered; b) an output section having: i) an outlet portion in fluid communication with the inlet portion and adapted to engage with a fill port; and ii) an adapter portion not in fluid communication with the input section and adapted to engage with a support member.

16 Claims, 6 Drawing Sheets

(56) References Cited

U.S. PATENT DOCUMENTS

| | | | | | |
|---|---|---|---|---|---|
| 5,878,799 | A * | 3/1999 | Hannick | B64F 1/28 | 141/351 |
| 5,979,516 | A * | 11/1999 | Grant | F01M 11/0408 | 141/331 |
| 6,085,806 | A * | 7/2000 | Davis | F16N 31/004 | 141/237 |
| 6,340,038 | B1 * | 1/2002 | Ingram | B67C 11/02 | 141/333 |
| 6,401,770 | B1 * | 6/2002 | Eimer | F16N 31/002 | 141/311 A |
| 7,213,621 | B1 * | 5/2007 | Chang | F16N 31/00 | 141/297 |
| 2004/0261902 | A1 * | 12/2004 | Eddins | F41B 9/0071 | 141/326 |
| 2007/0272328 | A1 * | 11/2007 | Chang | B01D 17/02 | 141/331 |
| 2008/0142114 | A1 * | 6/2008 | Cook | B65B 39/00 | 141/331 |
| 2010/0243105 | A1 * | 9/2010 | McGee | A01G 25/092 | 141/345 |
| 2013/0014859 | A1 * | 1/2013 | Friedlich | B67D 7/04 | 141/331 |
| 2013/0213762 | A1 * | 8/2013 | Gustafson | E04G 17/002 | 193/2 A |
| 2018/0155175 | A1 * | 6/2018 | Kuo | B67C 11/02 | |
| 2019/0003159 | A1 * | 1/2019 | Wowk | B60R 15/00 | |

* cited by examiner

FUNNEL

FIELD

The present teachings relate to a funnel. The funnel may be particularly useful with fill ports of recreational vehicles and filling of recreational vehicle fluid holding tanks. The funnel may be adaptable for multiple means of filling with fluid, from hoses to containers.

BACKGROUND

Recreational vehicles (RVs) typically include amenities for off-grid comfort. These amenities include electricity through onboard batteries and/or an incoming electricity connection, clean water through one or more water tanks and/or a fresh-water connection, and sewage storage and disposal through one or more holding tanks and/or sewage connections. To fill the one or more water tanks with fresh water, for later use, RVs generally include one or more inlet ports along an exterior wall and in fluid communication with the one or more water tanks located under the body of the RV. To fill the water tanks, a hose is placed into the inlet port and a user filling the tank holds the hose until the tank is full. This can be cumbersome and time-consuming, as the individual must remain at the port holding the hose and ensuring the hose does not slip.

In addition to filling the water tanks with fresh water, it is common to need to fill the tank with chemical treatments, other liquids, or just water from containers. These containers can range from smaller (e.g., easily held with one hand) to larger (e.g., 1 gallon, 2 gallons held with two hands). For example, antifreeze may need to be poured into the tanks for proper winterizing. As another example, when off-grid, users may refill their water tanks via large containers holding fresh water, as a hose connection is not available. For the smaller containers, a small funnel can be utilized with one hand holding the funnel and another hand holding the container. For the larger containers, typically two individuals may be needed to empty the container into the fill port and tank. For example, a first individual may hold the larger, heavier container with two hands while a second individual holds the funnel in place at the port.

What is needed is a device which is adapted to engage with a hose and allow for the hose to be sustained in place while filling the tank. What is needed is a device which is adapted to work with both small containers and large containers. What is needed is a device which allows for a user to fill a tank hands-free with a hose. What is needed is a device which allows for a single individual to fill a tank with a heavier container.

SUMMARY

The disclosure relates to a funnel comprising: a) an input section having an inlet portion which is tapered; b) an output section having: i) an outlet portion in fluid communication with the inlet portion and adapted to engage with a fill port; and ii) an adapter portion not in fluid communication with the input section and adapted to engage with a support member.

The disclosure relates to a funnel comprising: a) an input section having: i) an inlet portion which is tapered and has a substantially conical shape; ii) a first mating portion adjacent to and integral with the inlet portion which is substantially cylindrical; b) an output section having: i) a second mating portion which is received by the first mating portion such that the output section is in fluid communication with the input section; ii) an outlet portion in fluid communication with the input section via the second mating portion and adapted to engage with a fill port; and iii) an adapter portion blocked from fluid flow from the input section and adapted to engage with a support member; and where the second mating portion bifurcates to the outlet portion and adapter portion, such that the outlet portion and the adapter portion are integral with the second mating portion; and wherein the outlet portion is angled relative to the adapter portion.

The disclosure relates to a funnel assembly comprising: a) an input section having: i) an inlet portion which is tapered and has a substantially conical shape; ii) a first mating portion adjacent to and integral with the inlet portion which is substantially cylindrical; b) an output section having: i) a second mating portion which is received by the first mating portion such that the output section is in fluid communication with the input section; ii) an outlet portion in fluid communication with the input section via the second mating portion and adapted to engage with a fill port; and iii) an adapter portion blocked from fluid flow from the input section and at least partially hollow; c) a support member which is received in the adapter portion so as to be wedged between a support surface and the output section by being partially retained within the adapter portion; wherein the second mating portion bifurcates to the outlet portion and adapter portion, such that the outlet portion and the adapter portion are integral with the second mating portion; and wherein the outlet portion is angled relative to the adapter portion.

The funnel and/or funnel assembly of the present teachings may include one or more of the following features in any combination: the funnel may be configured to engage with the fill port of a recreational vehicle; the outlet portion may be angled relative to the adapter portion; the outlet portion may be angled relative to the adapter portion at an angle of about 40 degrees to about 110 degrees; there are one or more reinforcements may be between the outlet portion and the adapter portion; the one or more reinforcements may include one or more gussets; the input section may be a separate piece than the output section; the input section may be integral with the output section and the funnel may be a one-piece device; the input section may include a first mating portion engaged with a second mating portion of the output section; the second mating portion may bifurcate into the outlet portion and the adapter portion; the first mating portion may receive the second mating portion; the first mating portion may have a friction fit with the second mating portion; the first mating portion, the second mating portion, or both may be configured to engage with an end fitting of a hose; the first mating portion, the second mating portion, or both may have an interior diameter, a threaded fitting, or both which may allow for mating engagement with the end fitting of the hose; the inlet portion may taper toward and may be adjacent to the first mating portion; the first mating portion may be substantially cylindrical; the inlet portion may be substantially conical; the funnel may be part of a funnel assembly which may include a support member; the support member may have an adjustable length (e.g., telescoping); and the support member may be adapted to be wedged between a support surface (e.g., ground) and the funnel by being partially retained within the adapter portion.

The funnel of the present teachings may provide a device which is adapted to retain a hose. The funnel of the present teachings may provide a device which is able to engage with a fill port of a recreational vehicle. The funnel of the present teachings may provide a device which is compatible with small and large containers. The funnel of the present teachings may allow for hands-free filling. The funnel of the present teachings may be compatible with a support member.

DETAILED DESCRIPTION

Figure 1:
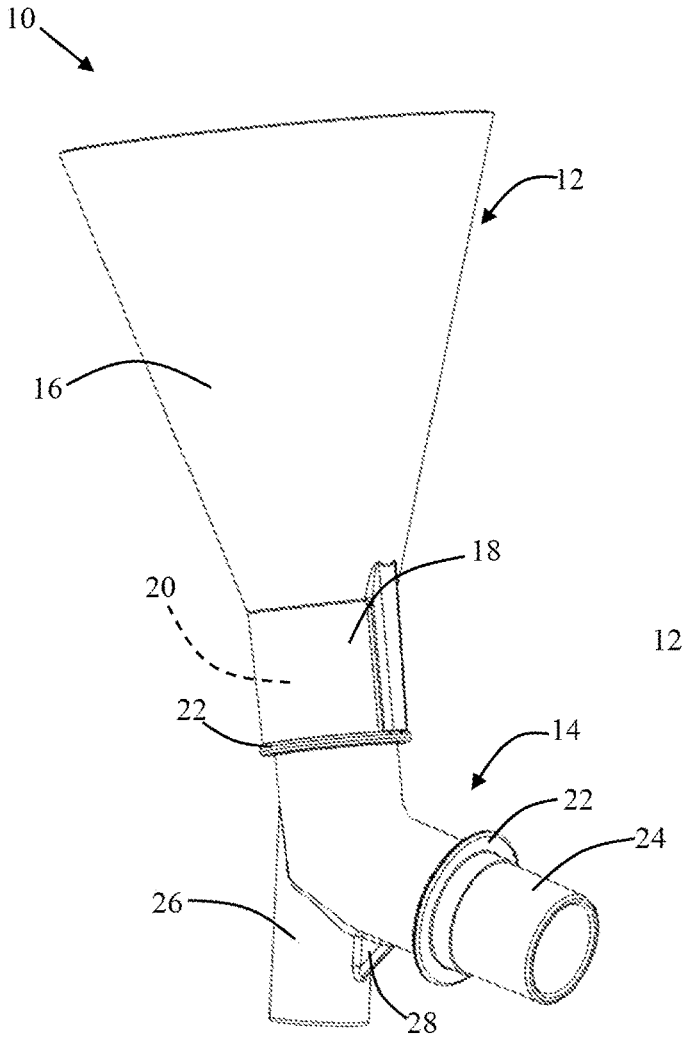
FIG. 1 is a perspective view of a funnel.

The present teachings meet one or more of the above needs by the improved devices and methods described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present disclosure relates to a funnel. The funnel may function to engage with a fill port, allow for fluid transfer into a water tank, funnel one or more liquids toward a fill port, allow for hands-free usage, be adaptable with one or more hoses, be adaptable with one or more containers, or any combination thereof. The funnel may include an input section, output section, or both. The funnel may include one or more inlet portions, mating portions, stops, outlet portions, adapter portions, reinforcements, engagement features, the like, or a combination thereof.

The funnel may be compatible with one or more fill ports. One or more fill ports may be in communication with one or more tanks. The one or more tanks may be one or more holding tanks. The one or more water tanks may be part of a vehicle. The vehicle may include one or more recreational vehicles, trucks, trains, airplanes, the like, or any combination thereof. One or more recreational vehicles may include one or more motorhomes, travel trailers, fifth-wheel trailers, folding trailers, truck campers, the like, or any combination thereof. The one or more vehicles may have one or more holding (e.g., water) tanks. The one or more tanks may be located within the body of the vehicle. The one or more tanks may be located under the body of the vehicle, such as in the chassis. The one or more holding tanks may include one or more water tanks, other types of liquid holding tanks, or a combination thereof. The one or more fill ports may be accessible from an exterior of the vehicle. The one or more fill ports may be on an exterior wall of the vehicle. The one or more fill ports may be in fluid communication with one or more tanks via one or more ducts, lines, or both. The one of more fill ports may be any suitable port for receiving and transferring one or more liquids to one or more tanks. The one or more fill ports may include one or more hatch inlets, recessed water inlets, flush-mount inlets, gravity inlets, the like, or any combination thereof.

The funnel may include an input section. The input section may function to receive a liquid; funnel a liquid toward a fill port; cooperate with one or more hoses, containers, other liquid delivery systems, and the like; mate with an output section; or any combination thereof. The input section may include an inlet portion, one or more mating portions, one or more reinforcements, one or more engagement members, or a combination thereof. The input section may include an inlet portion adjacent to a first mating portion. The input section may have a shape which is substantially conical, cylindrical, cuboidal, prismed, pyramidical, the like, or any combination thereof. For example, the input section may have a shape which includes both a conical portion and a cylindrical portion. The input section may receive one or more portions of an output section. Receive may mean be located within, about, or both. The input section may be affixed and/or integral with an output section. The input section may include an inlet portion adjacent and integral to a mating portion.

The input section may include an inlet portion. The inlet portion may function to collect a liquid, funnel a liquid toward an output section, or both. The inlet portion may have any suitable shape for collecting and funneling liquid. The inlet portion may have a shape which is substantially conical, cylindrical, cuboidal, prismed, pyramidical, the like, or any combination thereof. The inlet portion may have a shape which is substantially conical. The inlet portion may taper. The inlet portion may taper from a larger width (e.g., diameter) to a smaller width (e.g., diameter). The inlet portion may taper toward a mating portion (e.g., first mating portion). The inlet portion may taper from a rim to a mating portion and/or opening. The inlet portion may taper from a first width to a second width along a length.

The inlet portion may have a length. The length may be suitable for receiving liquid from a container and funneling toward an output section. The length may be suitable for receiving liquid from a smaller container (e.g., 8 oz) to a larger container (e.g., 5 gallons). The length may be suitable for receiving a portion of a hose. The length may be measured from a rim of the inlet portion to where taper may stop, a mating portion may begin, both. The length may be measured parallel to a longitudinal axis of the input section. A longitudinal axis may be concentric with the input section. The length may be about 2 inches or greater, about 3 inches or greater, about 4 inches or greater, or even about 4.5 inches or greater. The length may be about 10 inches or less, about 8 inches or less, about 6 inches or less, or even about 5 inches or less. For example, a length may be about 4.5 inches to about 5 inches. The inlet portion may have a first width (e.g., diameter). The first width may be a diameter at an opening, rim, or both. The first width may be an outer diameter. The first width may be about 2 inches or greater, about 3 inches or greater, or even about 4 inches or greater.

The first width may be about 10 inches or less, about 8 inches or less, about 6 inches or less, about 5 inches or less, or even about 4.5 inches or less. For example, the first width may be about 4 inches to about 4.5 inches. The inlet portion may have a second width (e.g., diameter). The second width may be opposite the first width, may be a diameter where tapering comes to an end, may be a width of a first mating portion, or any combination thereof. The second width may be an outer diameter. The second width may cooperate with the thickness of the inlet portion to allow a hose fitting to pass through and/or be retained. The second width may be about 0.5 inches or greater, about 0.75 inches or greater, about 1 inch or greater, or even about 1.25 inches or greater. The second width may be about 4 inches or less, about 3 inches or less, about 2 inches or less, or even about 1.5 inches for less. For example, the second width may be about 1 inch to 1.5 inches. The first width may have a ratio relative to the second width. The first width may have a ratio relative to the second width of about 10:1 or less, about 5:1 or less, about 4:1 or less, about 3:1 or less, about 2:1 or less, or even about 1.5:1 or less.

The input section, output section, or both may include one or more mating portions. The one or more mating portions may function to engage with one or more other mating portions; allow multiple pieces of a funnel to be assembled together into the funnel; receive, retain, and/or engage with one or more portions of a hose; transferring a liquid from an inlet portion to an outlet portion; function as a neck leading from an input section to an output section; or any combination thereof. The one or more mating portions may have any suitable shape for engaging with one or more other mating portions. The one or more mating portions may have a shape which is substantially conical, cylindrical, cuboidal, prismed, pyramidical, the like, or any combination thereof. One or more mating portions may have a shape reciprocal with one or more other mating portions. One or more mating portions may be cylindrical. One or more mating portions may include a first mating portion and a second mating portion. A first mating portion may be part of the input section. The first mating portion may be integral with and adjacent to the inlet portion. A second mating portion may be part of an output section. A second mating portion may be integral with and adjacent to an outlet portion, adapter portion, or any combination thereof. One or more of the mating portions may have a friction fit, threaded fit, keyed fit, the like, or any combination thereof with another mating portion, portion of a hose (e.g., hose end fitting), the like, or any combination thereof. For example, a first mating portion may receive the second mating portion therein and have a friction fit. As an example, a first mating portion may have an engagement member which has a keyed fit with an engagement member of a second mating portion. An interior surface of one or more mating portions may have a threaded fit to engage with a hose end fitting. As an example, the second mating portion may have a threaded interior surface to receive a portion of a hose therein.

The one or more mating portions may have an inner width (e.g., inner diameter). An inner width may function to allow the passing of fluid, passing of a portion of a hose, retaining an end fitting of a hose, engaging with one or more other mating portions, or any combination thereof. One or more mating portions may have an inner width smaller, about equal, or even larger than an outer width of one or more other mating portions, hose end fittings, or both. A first mating portion may have an inner width about equal to or larger than a width of a second mating portion. A second mating portion may have an inner width about equal to or larger than a width of a hose end fitting. The inner width may be about 0.25 inches or greater, about 0.5 inches or greater, about 0.75 inches or greater, or even about 0.8 inches or greater. The inner width may be about 5 inches or less, about 3 inches or less, about 2 inches or less, or even about 1 inch or less. For example, the inner width may be about 0.8 inches to about 1 inch. The second mating portion may be fully inserted into the first mating portion when one or more stops abut with a rim and/or exterior edge of a first mating portion.

The output section may include one or more stops. One or more stops may function to inform a user when a component of a funnel is inserted (e.g., seated) into another component of a funnel, a fill port, the like, or any combination thereof. The one or more stops may have any size, shape, and/or configuration suitable for preventing further insertion of a portion of a funnel into another cavity. The one or more stops may be formed as one or more protrusions about an exterior of one or more portions of a funnel. The one or more stops may be formed as one or more protrusions about a portion of an input section, an output section, or both. The one or more stops may be formed as one or more protrusions about one or more mating portions, outlet portions, adapter portions, or any combination thereof. One or more protrusions may include one or more tabs, keys, bulges, annular discs, the like, or any combination thereof. For example, one or more protrusions may include an annular disc-like shape about a portion of a mating portion, outlet portion, or both. The one or more protrusions may have a greater exterior width (e.g., diameter) than the portions to which it is affixed and/or integral to. The one or more protrusions may have a length smaller than the portions to which it is affixed to and/or integral with. The one or more stops may be solely be part of the output section.

The funnel may include one or more output sections. The one or more output sections may function to receive one or more liquids from an input section, transfer liquid to one or more fill ports or other receiving channels, cooperate with a support member, or any combination thereof. The one or more output sections may have any suitable size, shape, and/or configuration to provide for receiving of liquid, transferring of liquid, cooperating with a support member, or any combination thereof. The output section may have a shape which is substantially conical, cylindrical, cuboidal, prismed, pyramidical, the like, or any combination thereof. The outlet portion may be comprised of multiple cylindrical shapes at differing angles from one another. The output section may have a shape which bifurcates. For example, one portion may bifurcate into two portions. The outlet portion may include a mating portion (e.g., second mating portion), an outlet portion, an adapter portion, the like, or any combination thereof.

The funnel may include one or more outlet portions. The one or more outlet portions may function to receive liquid from an input section, one or more mating portions, or both. The one or more outlet portions may function to transfer liquid to one or more fill ports, channels, openings, the like, or any combination thereof. The one or more outlet portions may have any suitable size, shape, and/or configuration to receive and transfer liquid to a port. The one or more outlet portions may have a shape which is substantially conical, cylindrical, cuboidal, prismed, pyramidical, the like, or any combination thereof. The one or more outlet portions may have a shape which is substantially cylindrical. The one or more outlet portions may be partially or completely hollow. The one or more outlet portions may be completely hollow to allow for fluid to transfer from a mating portion through the outlet portion to a fill port. The one or more outlet portions may be located adjacent to one or more other portions of the output section. The one or more outlet portions may be located directly adjacent to one or more mating portions (e.g., second mating portions). The one or more outlet portions may be connected to one or more mating portions via one or more joints, elbows, the like, or both. The one or more outlet portions may be connected to a second mating portion via an elbow.

The one or more outlet portions may be substantially inline or angled relative to one or more mating portions. The one or more outlet portions may be at an angle that is acute, perpendicular, and/or obtuse to one or more mating portions. The one or more outlet portions may be at an angle of about 90 degrees or greater, about 100 degrees or greater, about 110 degrees or greater, or even about 120 degrees or greater relative to one or more mating portions. The one or more outlet portions may be at an angle of about 160 degrees or less, about 150 degrees or less, about 140 degrees or less, or even about 130 degrees or less relative to one or more mating portions. For example, one or more outlet portions may be at an angle of about 100 to 130 degrees relative to a first and/or second mating portion. This angle may allow for fluid to be further funneled with the aid of gravity toward a port, may allow for sufficient distance between an adapter portion and outlet portion to avoid interference with one another, or both.

The outlet portion may have a length. The length may be suitable for transferring liquid into a port, being received within a port, even supporting all or some of the weight of the funnel and liquid when located within a port. The length may be measured where the outlet portion angles away from a mating portion to an end (e.g., rim, edge). The length may be measured parallel to a longitudinal axis of the outlet portion. The length may be about 0.5 inches or greater, about 1 inch or greater, about 1.5 inches or greater, or even about 2 inches or greater. The length may be about 10 inches or less, about 5 inches or less, about 3 inches or less, or even about 2.5 inches or less. For example, a length may be about 2 inches to about 2.5 inches. The outlet portion may have an outer width. The outer width may be a diameter at an opening, rim, edge, or combination thereof. The outer width may be an outer diameter. The outer width may be suitable for being inserted into a fill port, opening, channel, and/or the like. The outer width may be about 0.25 inches or greater, about 0.5 inches or greater, about 0.75 inches or greater, or even about 1 inch or greater. The outer width may be about 3 inches or less, about 2 inches or less, about 1.5 inches or less, or even about 1.3 inches or less. For example, the outer width may be about 1 inch to about 1.3 inches. The outlet portion may have a substantially uniform width or a tapering width. The outlet portion may taper in width to the outer width at the opening, rim, and/or edge. The outlet portion may have a larger width closer to a mating portion. The width may taper to the outer width by a ratio of about 3:1 or less, about 2:1 or less, about 1.5:1 or less, about 1.3 or less, or even about 1.1:1 or less. The outlet portion may branch off from a mating portion, along with an adapter portion.

The funnel may include one or more adapter portions. The one or more adapter portions may function to cooperate with one or more support members, to prevent fluid flow, or both. The one or more adapter portions may have any suitable size, shape, and/or configuration to receive a support member, block fluid flow, or both. The one or more adapter portions may have a shape which is substantially conical, cylindrical, cuboidal, prismed, pyramidical, the like, or any combination thereof. The one or more adapter portions may have a shape which is substantially cylindrical. The one or more adapter portions may be partially or completely hollow. The one or more outlet portions may be partially hollow and partially filled. The one or more adapter portions may be partially solid where the adapter portion branches off from a mating portion. The solid portion may prevent the flow of liquid from a mating portion toward and through the adapter portion. The one or more adapter portions may be partially hollow at a free end located opposite a mating portion. The hollow portion may allow for the adapter portion to receive one or more support members therein. The one or more adapter portions may be located adjacent to one or more other portions of the output section. The one or more adapter portions may be located directly adjacent to one or more mating portions (e.g., second mating portions). The one or more adapter portions may be connected to one or more mating portions via one or more joints, elbows, the like, or both. The one or more adapter portions may be connected to a second mating portion via an elbow. The one or more adapter portions may branch off from one or more mating portions.

The one or more adapter portions may be substantially inline or angled relative to one or more mating portions. The one or more adapter portions may be at an angle that is acute, perpendicular, and/or obtuse to one or more mating portions. The one or more adapter portions may be at an angle of about 90 degrees or greater, about 150 degrees or greater, about 160 degrees or greater, or even about 170 degrees or greater relative to one or more mating portions. The one or more adapter portions may be at an angle of about 220 degrees or less, about 200 degrees or less, about 200 degrees or less, or even about 180 degrees or less relative to one or more mating portions. For example, one or more adapter portions may be at an angle of about 160 to 180 degrees relative to a first and/or second mating portion. This angle may allow for the adapter portion to provide support to the weight of first section when filled with fluid, sufficient distance from an outlet portion to avoid interference, or both.

The one or more adapter portions may be at an angle relative to one or more outlet portions. The angle between the two portions may allow for the adapter portion to be free of contact from one or more surfaces, walls, ports, and the like while allowing insertion of one or more outlet portions into one or more ports, openings, channels, and the like. The one or more adapter portions and outlet portions may each branch off from one or more mating portions. The angle may be measured as an angle between an adapter portion and an outlet portion. The one or more adapter portions may be at an angle that is acute, perpendicular, and/or obtuse to one or more outlet portions. The one or more adapter portions may be at an angle of about 40 degrees or greater, about 50 degrees or greater, about 60 degrees or greater, or even about 70 degrees or greater relative to one or more outlet portions. The one or more adapter portions may be at an angle of about 110 degrees or less, about 100 degrees or less, about 90 degrees or less, or even about 80 degrees or less relative to one or more outlet portions. For example, one or more adapter portions may be at an angle of about 60 to 90 degrees relative to an outlet portion.

The adapter portion may have a length. The length may be suitable receiving on or more support members, sustaining one or more ends of one or more support members, or both. The length may be measured where the adapter portion furcates from a mating portion to an end (e.g., rim, edge). The length may be measured parallel to a longitudinal axis of the adapter portion. The length may be about 0.2 inches or greater, about 0.3 inches or greater, about 0.5 inches or greater, about 1 inch or greater, about 2 inches or greater, or even about 2.5 inches or greater. The length may be about 10 inches or less, about 5 inches or less, about 4 inches or less, or even about 3.5 inches or less. For example, a length may be about 2 inches to about 2.5 inches. The adapter portion may have an inner width. The inner width may be a diameter at an opening, rim, edge, or combination thereof. The inner width may be an inner diameter. The inner width may be for receiving an end portion of a support member. The inner width may be about 0.25 inches or greater, about 0.5 inches or greater, about 0.75 inches or greater, or even about 0.8 inches or greater. The inner width may be about 5 inches or less, about 3 inches or less, about 2 inches or less, or even about 1 inch or less. For example, the inner width may be about 0.8 inches to about 1 inch. The inner width may be about equal to or larger than an outer width of a support member. An about equal width may allow for a friction fit of an end of the support member within the adapter portion.

The output section may include one or more reinforcements. The one or more reinforcement members may function to strengthen an angle between one or more adapter portions and one or more outlet portions. The one or more reinforcements may have any suitable size, shape, and/or configuration to provide structural support between one or more adapter portions and outlet portions. The one or more reinforcements may have a 2-dimensional shape which is triangular, square, rectangular, circular, ovular, elliptical, the like, or any combination thereof. For example, one or more reinforcements may have a substantially triangular shape. The one or more reinforcements may be formed as one or more gussets, ribs, webs, columns, the like, or any combination thereof. For example, a gusset may be between and connected to both an adapter portion and an outlet portion.

The funnel of the present teachings may be part of a funnel system. The funnel system may cooperate with a support member. A support member may function to provide additional support to the funnel. A support member may allow for a funnel to be held in place without the use of an individual's hands. The one or more support members may have any suitable size, shape, and/or configuration to provide structural support to a funnel, to be partially located within an adapter portion, or both. The one or more support members may have a shape which is substantially conical, cylindrical, cuboidal, prismed, pyramidical, the like, or any combination thereof. For example, the one or more support members may have a shape which is substantially cylindrical. The one or more support members may have a static or adjustable length. An adjustable length may allow for the support member to be adjusted for any varying location of a funnel. For example, different RVs may have fill ports located at different heights. The support member may be telescoping. The support member may prop the funnel up and provide support by being inserted into an adapter portion, being wedged between the funnel and a supporting surface (e.g., ground), or both. A suitable support member may include the Mr.LongArm® Extension Pole provided by Mr.LongArm, Inc.

The funnel of the present teachings may be comprised of one or more materials. The one or more materials may be compatible with fresh water, typical RV chemicals such as anti-freeze, and the like. The one or more materials may include one or more metals, polymeric materials, the like, or a combination thereof. One or more polymeric materials suitable for the funnel may include polyurethane (PUR), polystyrene (PS), polyvinyl chloride (PVC), polyethylene (PE), silicone, acrylonitrile butadiene styrene (ABS), polypropylene, polybutylene terephthalate, the like, or a combination thereof.

Illustrative Examples

Figure 2:
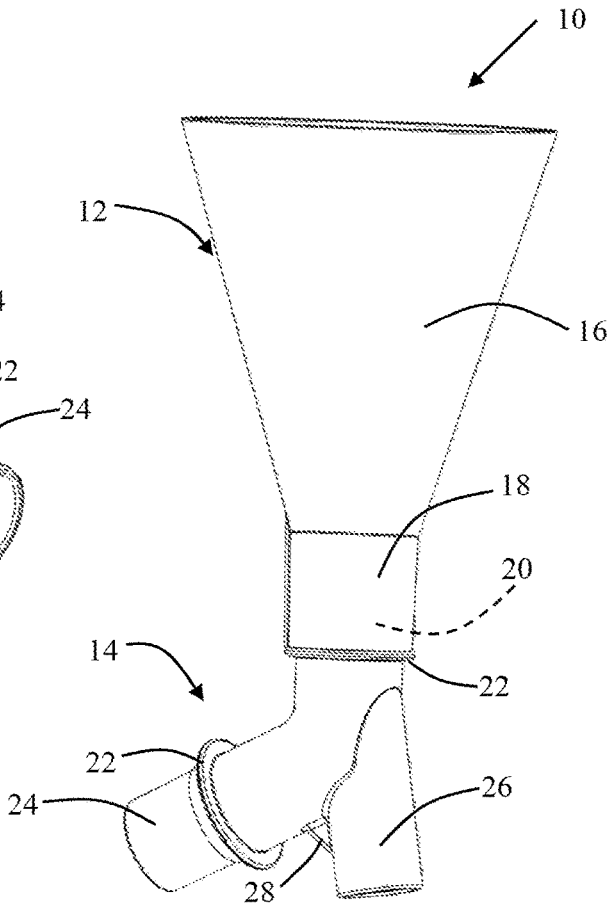
FIG. 2 is a perspective view of a funnel.

FIGS. 1 and 2 illustrate a funnel 10. The funnel 10 includes an input section 12 and an output section 14. The input section 12 includes an inlet portion 16. The inlet portion 16 is conically shaped. The inlet portion 16 tapers toward a first mating portion 18. The first mating portion 18 is substantially cylindrical. Received within the first mating portion 18 is a second mating portion 20. The second mating portion 20 is substantially cylindrical and part of the output section 14. The second mating portion 20 includes a stop 22. The stop 22 prevents the second mating portion 20 from extending too far in to the first mating portion 18. The output section 14 bifurcates to an outlet portion 24 and an adapter portion 26. The outlet portion 24 also includes a stop 22. The stop 22 ensures the outlet portion 24 is sufficiently located within a fill port 100 (not shown). The output section 14 includes a reinforcement 28 between the outlet portion 24 and the adapter portion 26.

Although the funnel 10 is illustrated as a two-piece device, it is contemplated that it can also be formed as one-piece or even more than two-pieces. For example, the first mating portion 18 may be integrally connected to the output section 12. The first mating portion 18 may bifurcate into the outlet portion 24 and the adapter portion 26.

Figure 3:
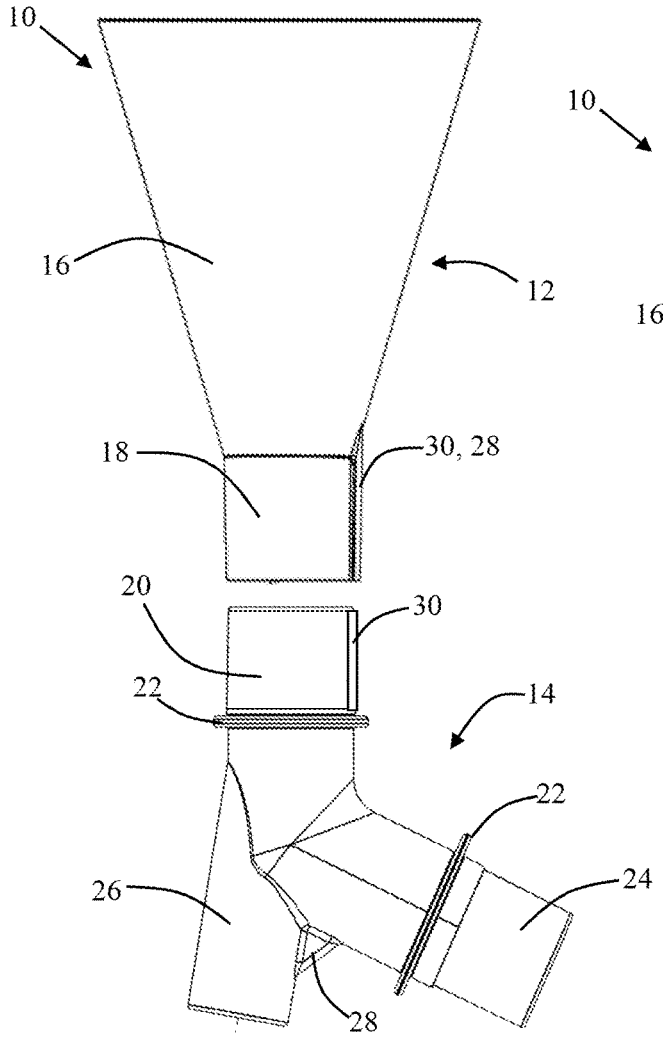
FIG. 3 is an exploded view of a funnel.

FIG. 3 illustrates an exploded view of a funnel 10. The funnel 10 includes an input section 12. The input section 12 includes an inlet portion 16. The inlet portion 16 is hollow and tapers toward a first mating portion 18. The first mating portion 18 is hollow and cylindrical. The inlet portion 16 is integral with and directly adjacent to the first mating portion 18. The first mating portion 18 includes an engagement feature 30. The funnel 10 includes an output section 14. The output section 14 includes a second mating portion 20. The second mating portion 20 also includes an engagement feature 30. The engagement features 30 are reciprocal with one another (e.g., male and female). The engagement feature 30 of the input section 12 may function or also be a reinforcement 28. The output section 14 may include or be free of an engagement feature 30 if the engagement feature 30 of the inlet portion 16 functions as a reinforcement 28. The second mating portion 20 branches into an outlet portion 24 and an adapter portion 26. The second mating portion 20 is at least partially hollow. The second mating portion 20 is in fluid communication with the outlet portion 24. The outlet portion 24 is hollow. The second mating portion 20 may not be in fluid communication with the adapter portion 26. Fluid may be able to pass from the second mating portion 20 to and through the outlet portion 24. Fluid may be prevented from passing from the second mating portion 20 to the adapter portion 26.

Figure 4:
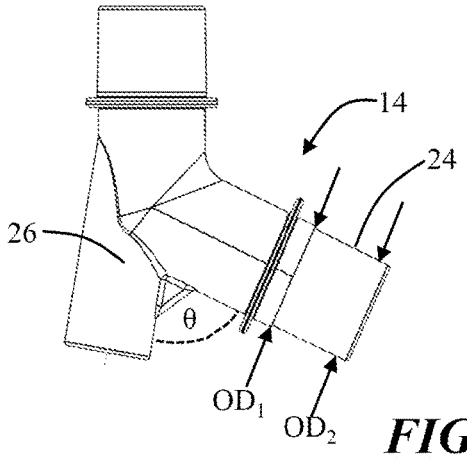
FIG. 4 is a plan view of an output section.

FIG. 4 illustrates a plan view of an output section 14. The output section 14 includes an adapter portion 26. The adapter portion 26 is at an angle θ relative to an outlet portion 24. The outlet portion 24 is formed as a hollow cylinder. The outlet portion 24 includes both a first diameter $OD_1$ and second outer diameter $OD_2$. The outlet portion 24 is in fluid communication with a second mating portion 20. The second mating portion 20 is also formed as a hollow cylinder.

Figure 5:
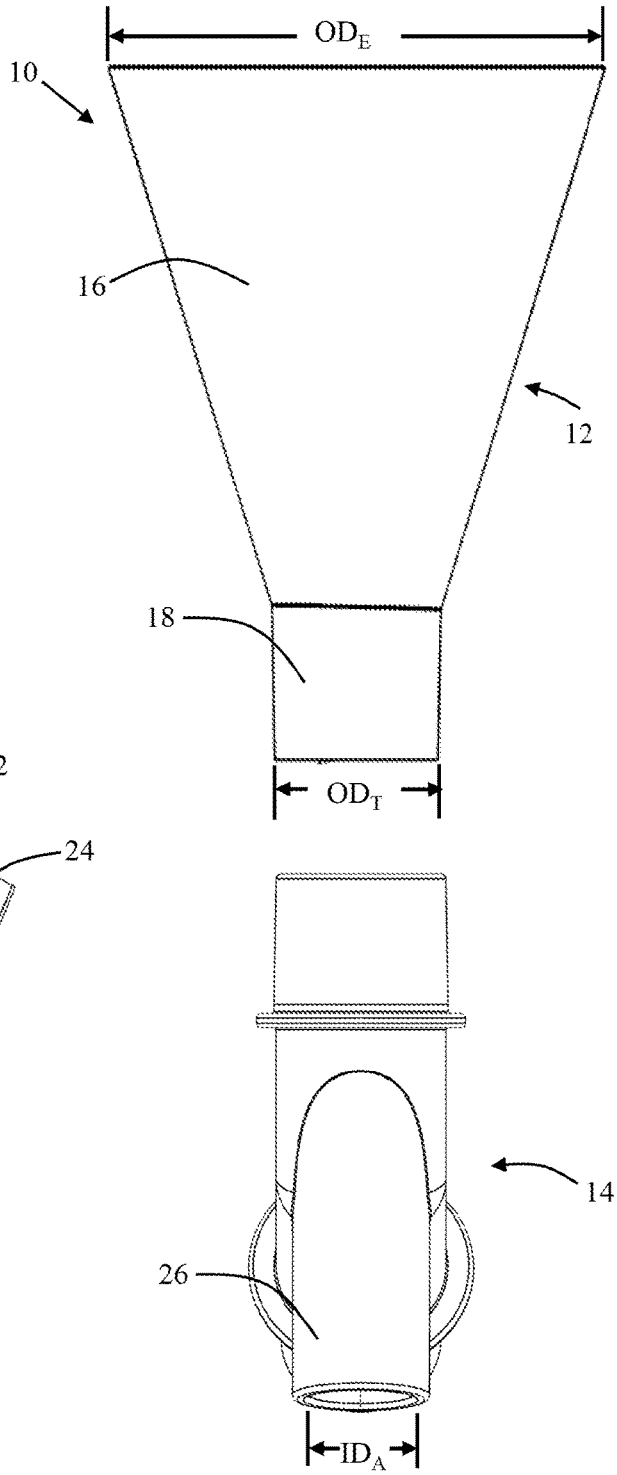
FIG. 5 illustrates an exploded view of a funnel.

FIG. 5 illustrates a plan and exploded view of a funnel 10. The funnel 10 includes an input section 12. The input section 12 includes an inlet portion 16 which tapers toward a first mating portion 18. Both the inlet portion 16 and the first mating portion 18 are hollow. The inlet portion 16 has an entry outer diameter $OD_E$ which tapers toward a tapered outer diameter $OD_T$. The tapered outer diameter $OD_T$ is substantially uniform through the first mating portion 18 which is substantially cylindrically shaped. The funnel includes an output section 14. The output section 14 includes an adapter portion 26. The adapter portion 26 is substantially cylindrical and hollow. The adapter portion includes an inner diameter $ID_A$.

Figure 6:
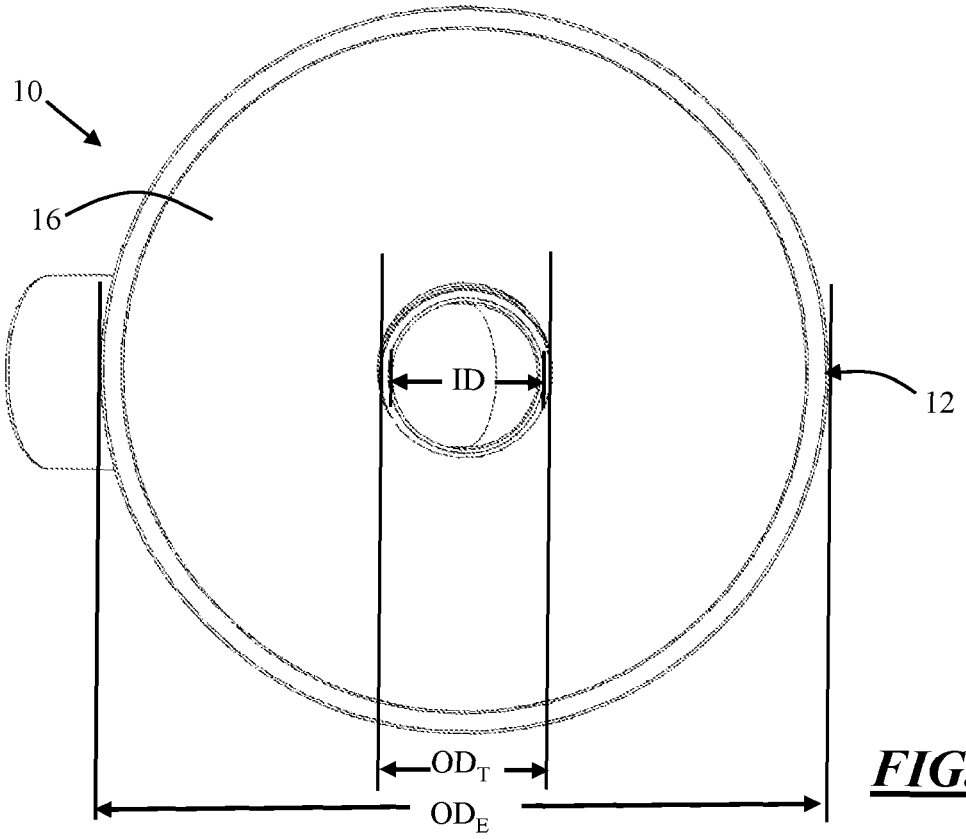
FIG. 6 is a top plan view of a funnel.
Figure 7:
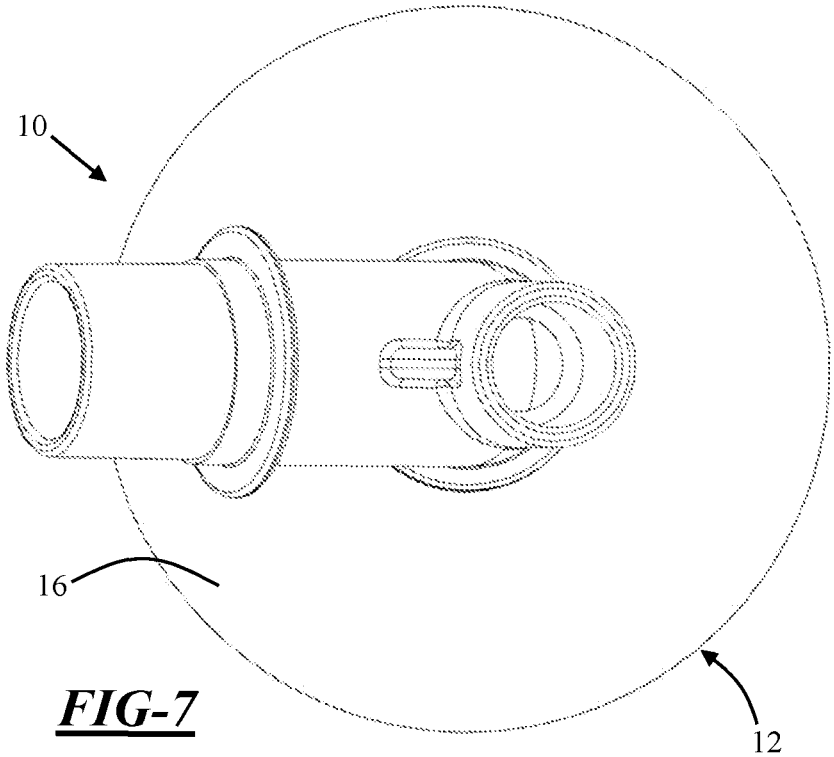
FIG. 7 is a bottom plan view of a funnel.

FIGS. 6 and 7 illustrates opposing plan views of a funnel 10. The funnel 10 includes an input section 12. The input section 12 includes an inlet portion 16. The inlet portion 16 has a tapered shape. The inlet portion 16 begins with an entry outer diameter $OD_E$ and funnels toward a tapered outer diameter. The inlet portion may taper toward an inner diameter ID. The inner diameter ID may also be the inner diameter of the second mating portion 20 extending through the first mating portion.

Figure 8:
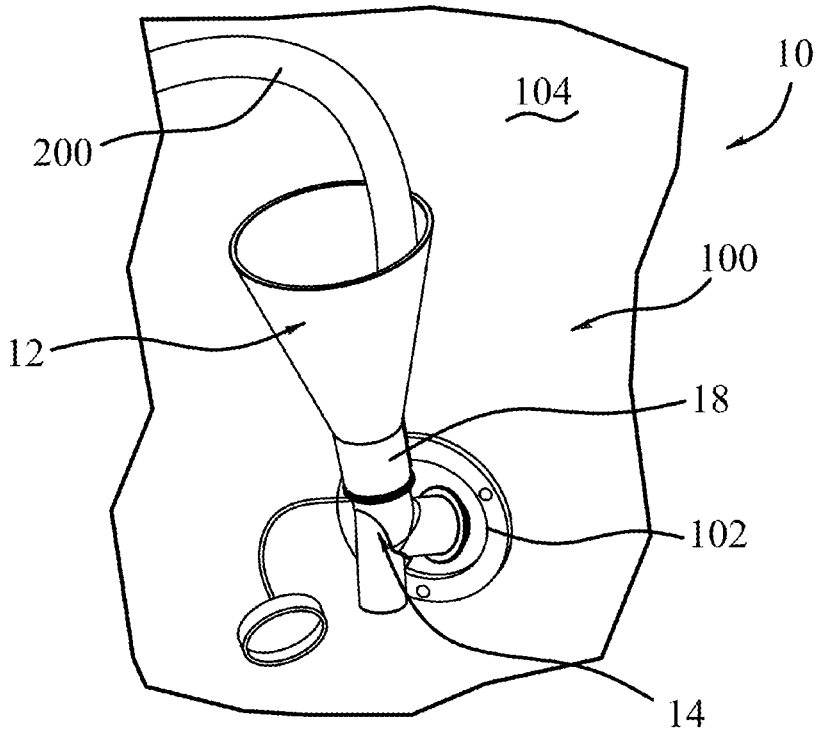
FIG. 8 illustrates a funnel with a hose.
Figure 9:
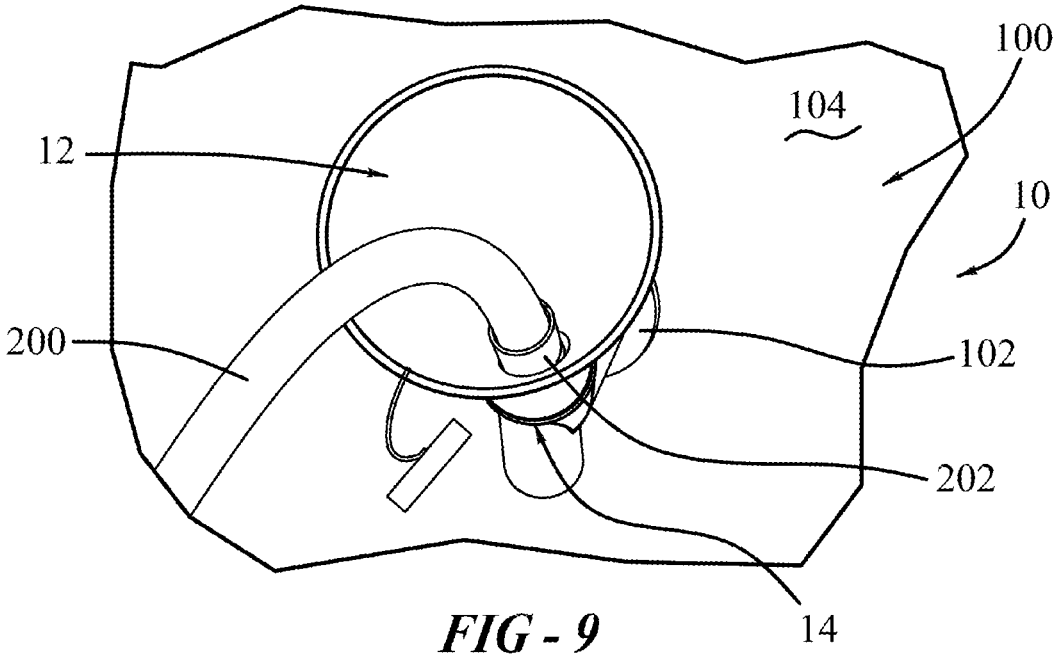
FIG. 9 illustrates a funnel with a hose.

FIGS. 8 and 9 illustrate the funnel 10 affixed to a vehicle 100. The funnel 10 is inserted into a fill port 102. The fill port 102 is located at an outside wall 104 of the vehicle 100. The output section 14 is inserted into the fill port 102. More specifically, the outlet portion 24 is inserted into and engaged with the fill port 102. The input section 12 faces generally upward. The input section 12 includes a hose 200 therein. The end fitting 202 of the hose 200 passes through the inlet portion 16. The end fitting 202 is at least partially located within the first mating portion 18. The end fitting 202 is held in place via a friction fit with an interior the first mating portion 18.

Figure 10:
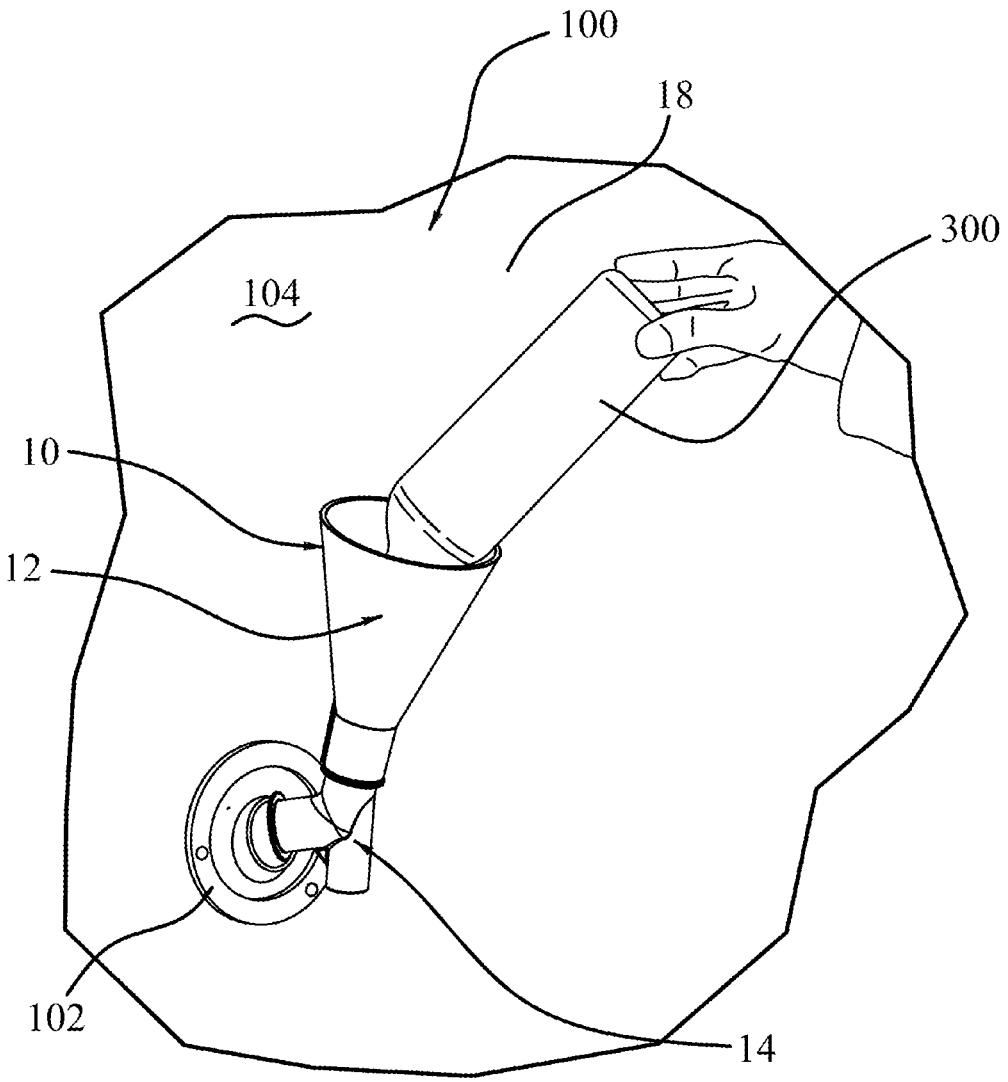
FIG. 10 illustrates a funnel affixed to a fill port and receiving liquid from a container.

FIG. 10 illustrates the funnel 10 affixed to a vehicle 100. The funnel 10 is inserted into a fill port 102. The funnel 10 is used for funneling one or more liquids from a container 300 into the fill port 102. The container 300 and/or liquid from the container 300 is disposed into the inlet portion 16. The inlet portion 16 funnels and transfers the liquid to the outlet portion 24.

Figure 11:
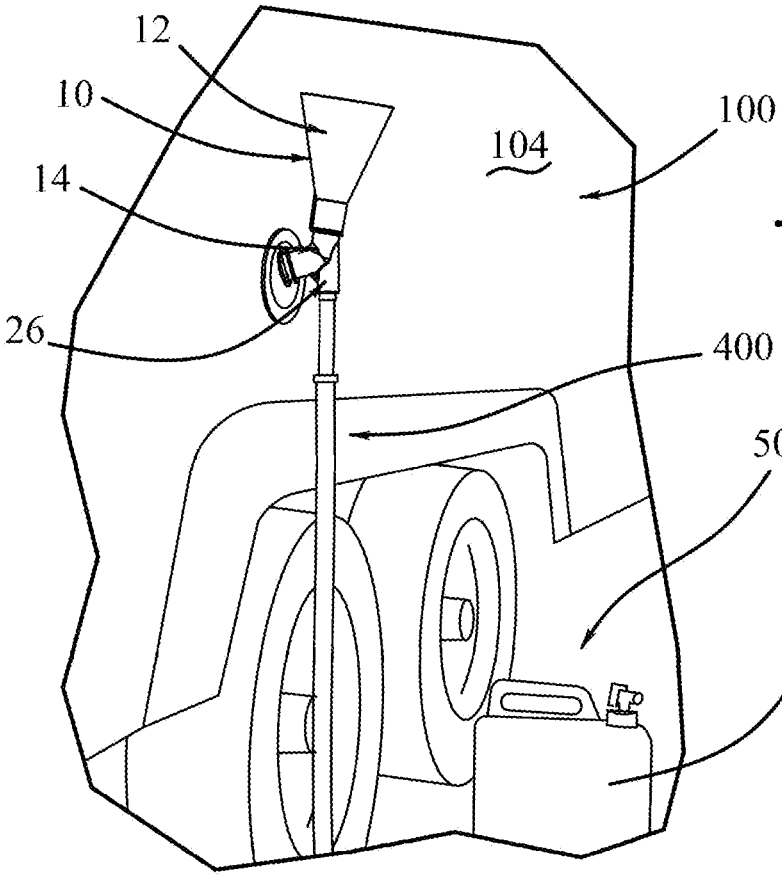
FIG. 11 illustrates a funnel affixed to a fill port and supported by a support member.
Figure 12:
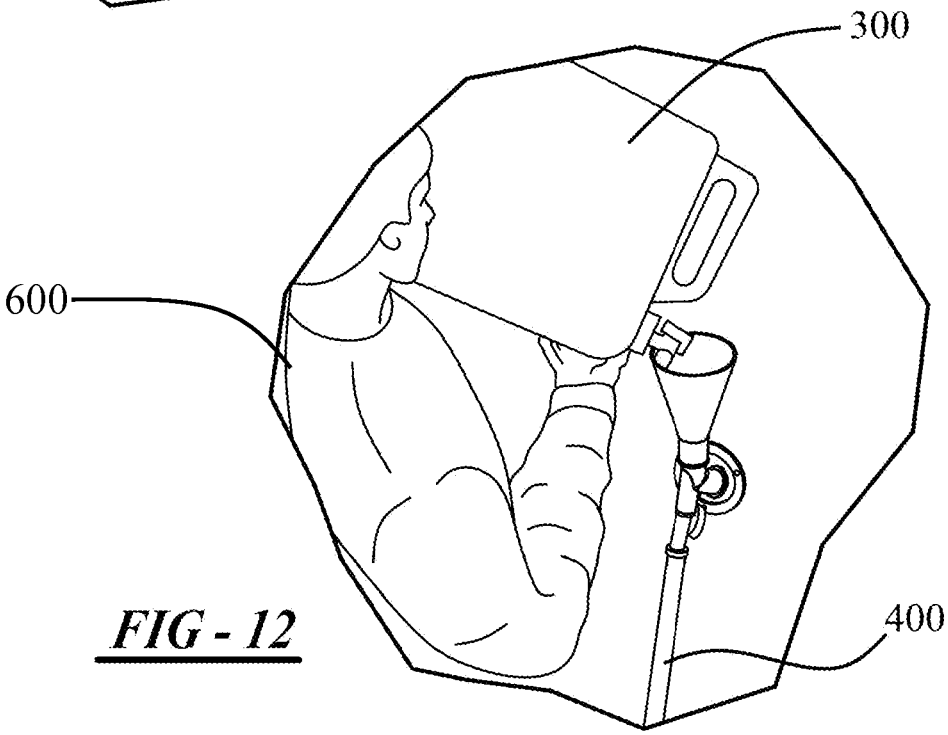
FIG. 12 illustrates a funnel affixed to a fill port and receiving liquid from a container.

FIGS. 11 and 12 illustrate the funnel 10 being supported by a support member 400. The support member 400 is substantially tubular shaped. The support member 400 has a shape substantially reciprocal with the interior of the adapter portion 26. The support member 400 is partially inserted into the adapter portion 26. The support member 400 is extendable. The support member 400 is wedged between the funnel 10 and the ground 500. The support member 400 aids in supporting weight of a container 300. The support member 400 aids in supporting of a mass volume of liquid filling the funnel 10 at once. As illustrated, an individual 600 is able to use two hands to hold the container 300 while the support member 400 supports the funnel 100.

Any numerical values recited in the above application include all values from the lower value to the upper value in increments of one unit provided that there is a separation of at least 2 units between any lower value and any higher value. These are only examples of what is specifically intended and all possible combinations of numerical values between the lowest value, and the highest value enumerated are to be considered to be expressly stated in this application in a similar manner. Unless otherwise stated, all ranges include both endpoints and all numbers between the endpoints.

The terms "generally" or "substantially" to describe angular measurements may mean about +/−10° or less, about +/−5° or less, or even about +/−1° or less. The terms "generally" or "substantially" to describe angular measurements may mean about +/−0.01° or greater, about +/−0.1° or greater, or even about +/−0.5° or greater. The terms "generally" or "substantially" to describe linear measurements, percentages, or ratios may mean about +/−10% or less, about +/−5% or less, or even about +/−1% or less. The terms "generally" or "substantially" to describe linear measurements, percentages, or ratios may mean about +/−0.01% or greater, about +/−0.1% or greater, or even about +/−0.5% or greater.

The term "consisting essentially of" to describe a combination shall include the elements, ingredients, components, or steps identified, and such other elements ingredients, components or steps that do not materially affect the basic and novel characteristics of the combination. The use of the terms "comprising" or "including" to describe combinations of elements, ingredients, components, or steps herein also contemplates embodiments that consist essentially of the elements, ingredients, components, or steps.

Plural elements, ingredients, components, or steps can be provided by a single integrated element, ingredient, component, or step. Alternatively, a single integrated element, ingredient, component, or step might be divided into separate plural elements, ingredients, components, or steps. The disclosure of "a" or "one" to describe an element, ingredient, component, or step is not intended to foreclose additional elements, ingredients, components, or steps.

The invention claimed is:

1. A funnel comprising:

a) an input section formed as a single uninterrupted piece of material having:

i) an inlet portion which is tapered and has a conical shape, wherein the inlet portion includes a wall which is free of any openings and defines a wider opening tapering toward a narrower opening, wherein the inlet portion includes a single rim continuous about and defining the wider opening, wherein the single rim is integral with and defines an edge of the wall, wherein tapering from the wider opening to the narrower opening commences at the single rim;

ii) a first mating portion adjacent to and integral with the inlet portion which is cylindrical and configured for a friction fit connection;

b) an output section formed as a single uninterrupted piece of material having:

i) a second mating portion which is received via the friction fit connection by the first mating portion such that the output section is in fluid communication with the input section;

ii) an outlet portion in fluid communication with the input section via the second mating portion and adapted to directly engage with a fill port; and iii) an adapter portion blocked from fluid flow from the input section and adapted to engage with a support member;

iv) one or more reinforcements between the outlet portion and the adapter portion, wherein the one or more reinforcements include one or more gussets integrally connected to and extending between the outlet portion and the adapter portion;

wherein the second mating portion bifurcates to the outlet portion and the adapter portion such that the outlet portion and the adapter portion are integral with the second mating portion;

wherein the outlet portion is angled relative to the second mating portion at an angle of about 90 degrees to about 160 degrees;

wherein the outlet portion is angled relative to the adapter portion at an angle of about 40 degrees to about 110 degrees;

wherein the first mating portion has a friction fit with the second mating portion such that the input section mates to and is engaged with the output section;

wherein the inlet portion, the first mating portion, and the second mating portion are aligned and concentric with one another;

wherein the first mating portion, the second mating portion, or both are configured to engage with an end fitting of a hose; and wherein the first mating portion, the second mating portion, or both have an interior diameter, a threaded fitting, or both which allows for mating engagement with the end fitting of the hose.

2. The funnel of claim 1, wherein the outlet portion is configured to engage with the fill port of a recreational vehicle.

3. The funnel of claim 1, wherein the inlet portion tapers toward and is adjacent to the first mating portion.

4. The funnel of claim 1, wherein the funnel is part of a funnel assembly;

wherein the funnel assembly includes the support member; and wherein the support member is adapted to be wedged between a support surface and the funnel by being partially retained within the adapter portion.

5. The funnel of claim 1, wherein the output section includes one or more stops formed as one or more annular protrusions integrally formed about the outlet portion; and wherein the one or more stops are configured to prevent further insertion of the outlet portion into the fill port.

6. The funnel of claim 5, wherein the wider opening has a first width which is a diameter of about 2 inches or greater to about 10 inches or less.

7. The funnel of claim 6, wherein the narrower opening has a second width which is a diameter of about 0.5 inches or greater to about 4 inches or less.

8. The funnel of claim 7, wherein the input section includes one or more other reinforcements formed as one or more ribs; and wherein the one or more ribs are integral with and connect the inlet portion to the first mating portion.

9. A funnel comprising:

a) an input section formed as a single uninterrupted piece of material having:

i) an inlet portion which is tapered and has a conical shape, wherein the inlet portion includes a wall which is free of any openings and defines a wider opening tapering toward a narrower opening, wherein the inlet portion includes a single rim continuous about and defining the wider opening, and wherein the single rim is integral with and defines an edge of the wall, wherein tapering from the wider opening to the narrower opening commences at the single rim;

ii) a first mating portion adjacent to and integral with the inlet portion which is cylindrical, wherein the inlet portion tapers toward and is adjacent to the first mating portion and configured for a friction fit connection;

iii) one or more reinforcements formed as one or more ribs, wherein the one or more ribs are integral with and connect the inlet portion to the first mating portion;

b) an output section formed as a single uninterrupted piece of material having:

i) a second mating portion which is received via the friction fit connection by the first mating portion such that the output section is in fluid communication with the input section, wherein the inlet portion, the first mating portion, and the second mating portion are aligned and concentric with one another;

ii) an outlet portion in fluid communication with the input section via the second mating portion and adapted to directly engage with a fill port;

iii) an adapter portion blocked from fluid flow from the input section and adapted to engage with a support member;

iv) one or more other reinforcements between the outlet portion and the adapter portion, wherein the one or more other reinforcements include one or more gussets integrally connected to and extending between the outlet portion and the adapter portion;

v) one or more stops formed as one or more annular protrusions integrally formed about an outlet diameter of the outlet portion, wherein the one or more stops are configured to prevent further insertion of the outlet portion into the fill port;

wherein the second mating portion bifurcates to the outlet portion and the adapter portion, such that the outlet portion and the adapter portion are integral with the second mating portion;

wherein the outlet portion is angled relative to the adapter portion;

wherein the first mating portion, the second mating portion, or both are configured to engage with an end fitting of a hose; and wherein the first mating portion, the second mating portion, or both have an interior diameter, a threaded fitting, or both which allows for a mating engagement with the end fitting of the hose.

10. The funnel of claim 9, wherein the outlet portion is angled relative to the second mating portion at an angle of about 90 degrees to about 160 degrees.

11. The funnel of claim 10, wherein the outlet portion is angled relative to the adapter portion at an angle of about 40 degrees to about 110 degrees.

12. The funnel of claim 11, wherein the first mating portion has a friction fit with the second mating portion.

13. The funnel of claim 12, wherein the outlet portion is configured to engage with the fill port of a recreational vehicle.

14. A funnel assembly comprising:

a) an input section formed as a single uninterrupted piece of material having:

i) an inlet portion which is tapered and has a conical shape free of any additional openings;

ii) a first mating portion adjacent to and integral with the inlet portion which is cylindrical and configured for a friction fit connection, wherein the inlet portion tapers toward and is adjacent to the first mating portion;

b) an output section formed as a single uninterrupted piece of material having:

i) a second mating portion which is received via the friction fit connection by the first mating portion such that the output section is in fluid communication with the input section, wherein the inlet portion, the first mating portion, and the second mating portion are aligned and concentric with one another;

ii) an outlet portion in fluid communication with the input section via the second mating portion and adapted to directly engage with a fill port; and iii) an adapter portion blocked from fluid flow from the input section and at least partially hollow;

iv) one or more reinforcements between the outlet portion and the adapter portion;

v) one or more stops formed as one or more annular protrusions integrally formed about an outlet diameter of the outlet portion, wherein the one or more stops are configured to prevent further insertion of the outlet portion into the fill port;

c) a support member which is received in the adapter portion so as to be wedged between a support surface and the output section by being partially retained within the adapter portion;

wherein the second mating portion bifurcates to the outlet portion and the adapter portion, such that the outlet portion and the adapter portion are integral with the second mating portion; and wherein the outlet portion is angled relative to the adapter portion.

15. The funnel assembly of claim 14, wherein the input section includes one or more other reinforcements formed as one or more ribs; and wherein the one or more ribs are integral with and connect the inlet portion to the first mating portion.

16. The funnel assembly of claim 14, wherein the inlet portion includes a wall which defines a wider opening tapering toward a narrower opening, wherein the inlet portion includes a single rim continuous about and defining the wider opening, and wherein the single rim is integral with and defines an edge of the wall;

wherein the wider opening has a first width which is a diameter of about 2 inches or greater to about 10 inches or less;

wherein the narrower opening has a second width which is a diameter of about 0.5 inches or greater to about 4 inches or less; and wherein the outlet portion at a free end has an outer width having a diameter of about 0.25 inches or greater to about 3 inches or less.

* * * * *